US012460507B2

(12) United States Patent
Wyatt et al.

(10) Patent No.: US 12,460,507 B2
(45) Date of Patent: Nov. 4, 2025

(54) APPARATUS AND METHOD OF REDUCING SURGE WHEN RUNNING CASING

(71) Applicant: Halliburton Energy Services, Inc., Houston, TX (US)

(72) Inventors: Nathan Barrett Wyatt, Houston, TX (US); Lonnie Carl Helms, Houston, TX (US); Tor Sigve Saetre, Tananger (NO); Frank Vinicia Acosta Villarreal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 6 days.

(21) Appl. No.: 18/082,102

(22) Filed: Dec. 15, 2022

(65) Prior Publication Data

US 2023/0392472 A1 Dec. 7, 2023

Related U.S. Application Data

(60) Provisional application No. 63/349,467, filed on Jun. 6, 2022.

(51) Int. Cl.
*E21B 4/16* (2006.01)
*E21B 34/06* (2006.01)
*E21B 34/14* (2006.01)

(52) U.S. Cl.
CPC ..... *E21B 34/063* (2013.01); *E21B 4/16* (2013.01); *E21B 34/142* (2020.05); *E21B 2200/06* (2020.05)

(58) Field of Classification Search
CPC ..... E21B 34/063; E21B 34/142; E21B 4/16; E21B 2200/06
See application file for complete search history.

(56) References Cited

U.S. PATENT DOCUMENTS 5,117,910 A 6/1992 Brandell et al.
5,181,569 A 1/1993 McCoy et al.
5,960,881 A * 10/1999 Allamon ..... E21B 34/142 166/70
6,079,490 A * 6/2000 Newman ..... E21B 41/00 702/6
6,769,490 B2 8/2004 Allamon et al.
7,694,732 B2 4/2010 Rogers et al.
9,103,189 B2 * 8/2015 Pacey ..... E21B 33/12
(Continued)

FOREIGN PATENT DOCUMENTS

WO 2019083376 A1 5/2019

OTHER PUBLICATIONS

Halliburton Energy Services Operating and Maintenance Instructions No. SAP No. 102047596, Ball-Drop SuperFill Surge-Reduction System Operating and Maintenance, Apr. 2020, cover page and pp. 7, 15, 16, 17, 18.
(Continued)

*Primary Examiner* — Nicole Coy
*Assistant Examiner* — Douglas S Wood
(74) *Attorney, Agent, or Firm* — McAfee & Taft

(57) ABSTRACT

A downhole tool has a tool body with a tool body outer diameter. A liner with a liner outer diameter is connected to the tool body. The tool body has a plurality of diverter ports defined in a wall thereof. A closing sleeve is movable in the tool body to close the diverter ports. A closing seat attached to the closing sleeve is a frangible closing seat.

20 Claims, 9 Drawing Sheets

(56) References Cited

U.S. PATENT DOCUMENTS

| | | | | |
|---|---|---|---|---|
| 9,267,347 | B2 * | 2/2016 | Agrawal | E21B 23/00 |
| 9,540,892 | B2 | 1/2017 | Watson | |
| 9,605,508 | B2 * | 3/2017 | Xu | E21B 33/12 |
| 10,557,329 | B2 | 2/2020 | Gao et al. | |
| 10,837,265 | B2 | 11/2020 | Kohn et al. | |
| 11,162,325 | B2 * | 11/2021 | Tunes | E21B 29/08 |
| 11,248,442 | B2 | 2/2022 | Barlow et al. | |
| 11,408,253 | B1 * | 8/2022 | Deng | E21B 40/001 |
| 11,680,462 | B2 | 6/2023 | Tunes | |
| 11,795,772 | B2 * | 10/2023 | Roselier | E21B 23/0413 |
| 2001/0045288 | A1 * | 11/2001 | Allamon | E21B 21/10 166/380 |
| 2006/0118295 | A1 | 6/2006 | Rogers et al. | |
| 2006/0118336 | A1 | 6/2006 | Rogers et al. | |
| 2008/0105434 | A1 | 5/2008 | Orbell et al. | |
| 2009/0159289 | A1 * | 6/2009 | Avant | E21B 33/1285 166/316 |
| 2010/0155084 | A1 | 6/2010 | Watson et al. | |
| 2016/0265319 | A1 | 9/2016 | Jackson et al. | |
| 2016/0340995 | A1 * | 11/2016 | Walton | E21B 33/12 |
| 2016/0340996 | A1 * | 11/2016 | Hess | E21B 29/02 |
| 2018/0135366 | A1 | 5/2018 | Olsen et al. | |
| 2019/0145218 | A1 | 5/2019 | Roseman et al. | |
| 2021/0317711 | A1 | 10/2021 | Jordan et al. | |
| 2022/0081992 | A1 | 3/2022 | Tunes | |

OTHER PUBLICATIONS

International Search Report and Written Opinion dated Jun. 8, 2023, issued in corresponding PCT Application No. PCT/US2023/013117.

Halliburton Energy Services, "SuperFill Casing Equipment Product Review", May 2011, pp. 1-16.

Halliburton Energy Services Operating and Maintenance Manual, "Ball-Drop SuperFill Surge-Reduction System Operating and Maintenance Manual", SAP No. 102047596, Sep. 2011, pp. 1-26.

* cited by examiner

APPARATUS AND METHOD OF REDUCING SURGE WHEN RUNNING CASING

CROSS-REFERENCE TO RELATED APPLICATION

This application claims the benefit of U.S. Provisional Application No. 63/349,467 filed on Jun. 6, 2020, which is hereby incorporated by reference.

FIELD

The present disclosure relates to a diverter tool used to increase the run-in speed of a casing string and to reduce pressure created when tight tolerances exist between a casing and the wellbore into which the casing is being placed.

BACKGROUND

During some well completion operations, a casing, or other string lowered into a well creates a tight tolerance with the wellbore. In such cases, the casing must often be run in slowly, and can create unwanted pressure on the formations through which it is lowered. In addition, there can be a piston, or jarring effect created in such scenarios.

Oftentimes when a casing is lowered into a well, surge pressure is created during the lowering process. Surge pressure arises as a result of tight tolerance casing clearances. When there is a close fit between the outer diameter of the casing lowered into the well and the inside of the wellbore that the casing is being run into surge pressure is often generated. Surge reduction diverters are often run as a section of the drill pipe. Existing surge reduction devices may use metallic expandable seats as a means to increase pressure to close ports in a ported device. Cracking, failing to seal and dart damage are issues that may arise with metallic expandable seats.

SUMMARY

The current disclosure is directed to a surge reduction diverter tool. In one embodiment the surge reduction diverter tool can be run with a confirmation device. The surge reduction diverter tool is useful on all types of wells, but particularly offshore deep water wells that can possess many close tolerance casing strings. The surge reduction diverter tool can be used in conjunction with autofill float equipment and will improve the run-in-hole speeds of casing strings. Such a process can reduce rig time compared to conventional casing running methods. Use of the surge reduction diverter tool disclosed herein can also reduce the piston effect associated with tight tolerance casing clearances, and further protects the open hole formation below while running to the bottom of the drilled hole section.

The surge reduction diverter tool disclosed herein may be included in a drill pipe that lowers a casing into a well. The outer diameter of the drill pipe is generally smaller than the outer diameter of the casing being lowered. The surge reduction diverter tool includes a frangible seat that catches a ball, and in one embodiment is a glass seat that catches a ball. The surge reduction diverter tool may be closed with an increase in pressure above the seated ball which moves a sleeve downwardly to cover ports in the surge reduction diverter tool. Once the ports are closed pressure applied above the seated ball will cause the glass seat to shatter, leaving a fully open bore. Net pressure above the glass seat is used to close the diverter ports. With the frangible seat disclosed, no pressure loss is experienced.

Large ports in the surge reduction diverter tool allow autofill drilling mud to pass from the inside of the tool to the drill pipe annulus outside the tool as the casing is lowered. The ports act as a pressure relief for the surge that is created while running casing strings in tight tolerance scenarios. Dropping a ball from the surface and landing on the glass ball seat fixed to a closing sleeve with seals stroke the tool into a closed position restoring pressure integrity to the drill pipe prior to circulating or cementing.

When a ball is dropped into the drill pipe and lands on the glass seat, pressure is applied to the surge reduction drill pipe diverter seat. The pressure will cause the closing sleeve to detach from the drill pipe and the closing sleeve will move to close the diverter ports. After the closing sleeve is closed the frangible seat will shatter and the closing ball and small glass fragments can be pumped down the well.

A surge reduction drill pipe diverter confirmation device with an identical glass seat may be used, which allows the drill pipe to be tested and confirms that the surge reduction drill pipe diverter tool has closed prior to pumping cement into the well. The use of a closing confirmation device with a glass ball seat as part of a surge reduction system is optional. The optional closing confirmation device, prior to cementing, will serve to test or confirm that the ported surge reduction drill pipe diverter tool above has closed and that the ports are isolated by the closing sleeve. A pressure spike will be recognized when the closing ball lands on a confirmation closing seat in the confirmation device. The confirmation closing seat will then shatter in the same manner as described with respect to the closing seat and the closing ball and glass fragments are further circulated down the drill string and out the casing below.

A surge reduction diverter tool as disclosed herein using a glass seat will be universally compatible in that it can be used in connection with different liner hangers or casing landing strings.

Various embodiments of the present disclosure will be understood more fully from the detailed description given below and from the accompanying drawings of various embodiments of the disclosure. In the drawings, like reference numbers may indicate identical or functionally similar element

DESCRIPTION OF THE DRAWINGS

FIG. 6 illustrates a cross-sectional view of the surge reduction diverter tool disclosed herein in a run-in position used with a confirmation device.

FIG. 9 illustrates a cross-sectional view of the surge reduction diverter tool disclosed herein after the frangible seat has been shattered used with a confirmation device.

DESCRIPTION OF AN EMBODIMENT

Figure 1:
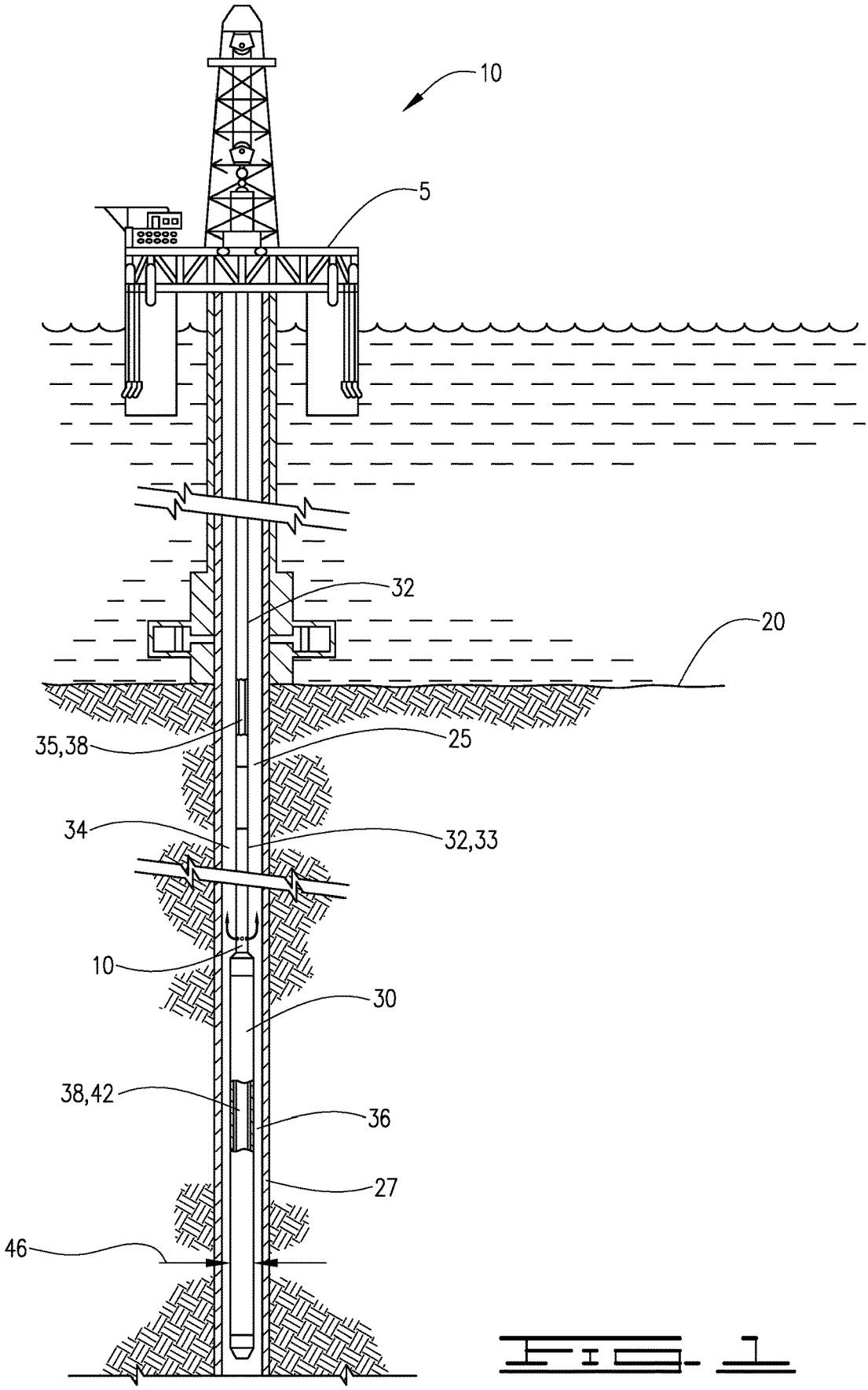
FIG. 1 is a schematic of the surge reduction diverter tool lowered into a subsea wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

Illustrative embodiments and related methods of the present disclosure describe a surge assembly and a method for use of the surge assembly. The method includes a method for reducing surge when running casing into a well bore. The surge assembly may comprise a diverter tool that forms a portion of a working string that extends from the surface of a well. The diverter tool may be connected at the upper end thereof to a drill string, and may have a casing connected therebelow. Fluid flowing up through the casing as it is lowered into the well will pass into a flow passage defined by the diverter tool, and through diverter ports in a wall of the diverter tool into an annulus between the diverter tool and the wellbore.

FIG. 1 is a schematic illustration of an offshore oil and gas platform operably coupled to a working string that includes a surge assembly. The offshore oil and gas platform is generally designated by the number 5. The diverter tool is designated by the number 10. FIG. 1 depicts use of the diverter tool in connection with an offshore operation, but it will be understood by those skilled in the art that the apparatus according to the present disclosure is equally well suited for use in onshore operations. Likewise, while FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores, or the like. Referring to FIG. 1, offshore platform 5 may have a work string, for example a drill pipe 32 extending therefrom into a wellbore 25 drilled into a sea floor 20. Wellbore 25 extends through formations in the earth below the sea floor. The current disclosure shows a previously installed casing 27 in the wellbore 25 but it is understood that the diverter tool may be used in a non-cased wellbore.

Drill pipe 32 may comprise a plurality of connected tubulars 33. A casing 30, which may also be referred to as a liner, may be connected to and extend from the diverter tool 10. An annulus 34 is defined by and between previously installed casing 27 and diverter tool 10. An annulus 36 is defined by and between casing 30 and previously installed casing 27. Annulus 34 is larger than annulus 36. A flow path 38 extends through drill string 32, diverter tool 10 and casing 30. Flow path 38 may comprise drill string flow path 35, diverter tool flow path 40 and casing flow path 42. An outer diameter 44 of diverter tool 10 is smaller than an outer diameter 46 of the casing 30 therebelow. The outer diameter of the drill string 32 will in many cases be the same as the outer diameter 44, and in any case will be smaller than outer diameter 46.

Surge reduction diverter tool 10 comprises a diverter body, or tool body 50, which may be a section of a drill pipe. Tool body 50 has a plurality of diverter ports 52 defined in wall 54 thereof. Tool body 50 has inner surface 56. Diverter ports 52 will communicate central flow path of surge reduction diverter 10, and more particularly of tool body 50 with annulus 34.

A closing sleeve 60 is detachably connected in tool body 50 in a first position 61 shown in FIG. 1. A closing seat 62 is fixed to closing sleeve 60. Closing seat 62 defines an opening 64 therethrough. Closing seat 62 is a frangible closing seat and in one embodiment is a glass closing seat that will shatter once engaged by a closing ball, and the application of pressure above the closing ball is increased to provide sufficient force to shatter the closing seat 62. The closing seat 62 will shatter after the closing sleeve 60 has moved in the tool body 50 to close ports 52. Closing sleeve 60 has seals 66 that will sealingly engage inner surface 56 of tool body 50.

Closing sleeve 60 comprises a closing sleeve body 68 and a closing sleeve extension 70 connected thereto. Closing sleeve 60 has groove 72 defined therein in which closing seat 62 may be fixed. A mounting sleeve 80 is fixed in tool body 50. Mounting sleeve 80 is fixed against downward movement in tool body 50 by, for example, a shoulder 81 defined in tool body 50. Closing sleeve 60 is detachably connected in tool body 50. Shear pins 82 connect closing sleeve to mounting sleeve 80 so that when detached, closing sleeve 60 is movable in tool body 50, while mounting sleeve 80 stays stationary.

Figure 2:
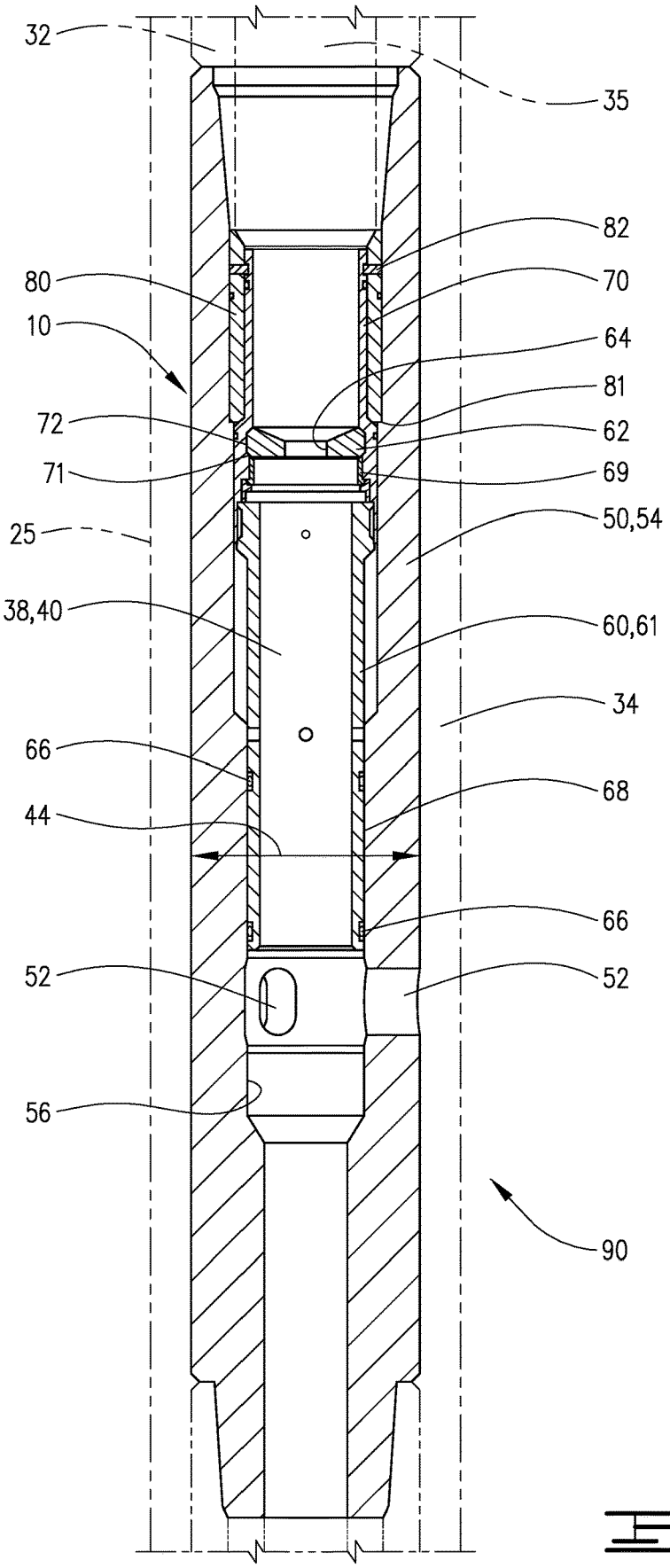
FIG. 2 illustrates a cross-sectional view of a surge reduction diverter tool disclosed herein in a run-in position.
Figure 3:
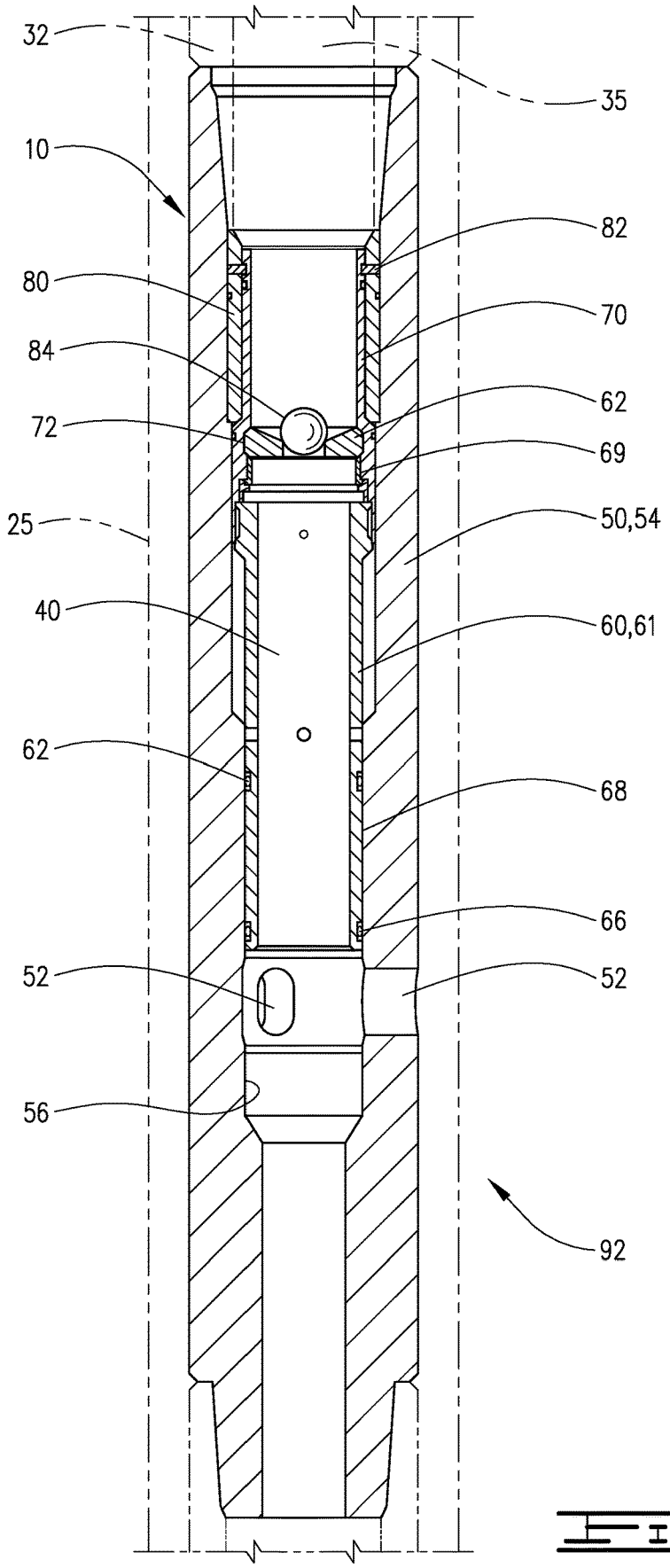
FIG. 3 illustrates a cross-sectional view of the surge reduction diverter tool disclosed herein after a ball has been seated.

In operation, surge reduction diverter tool 10 is connected to a work string, for example drill string 32. Drill string 32, with diverter tool 10 connected thereto will be connected to casing 30 therebelow. Surge reduction diverter tool 10 may be used in conjunction with an autofill device, for example float shoes or collars with autofill features that allow fluid to flow into the casing and upwardly therethrough as the casing 30 is lowered into a wellbore. Diverter tool 10 is in the run-in position in FIG. 2. In the run-in position 90 fluid passing upwardly though the casing 30 will enter surge reduction diverter tool 10 and will pass out diverter ports 52 into annulus 34 outside surge reduction diverter tool 10. Once the casing 30 has reached the desired destination a shifting ball 84 may be dropped to engage closing seat 62. The landed position 92 of diverter tool 10 is shown in FIG. 3. In the landed position 92, the closing sleeve 60 has not yet moved to its second position 63 in tool body 50. When ball 84 is landed, the ball is seated such that there is no flow therethrough, and no pressure loss. As a result, the net pressure above ball 84 is used to move closing sleeve 60, and thereafter to shatter closing seat 62.

Figure 4:
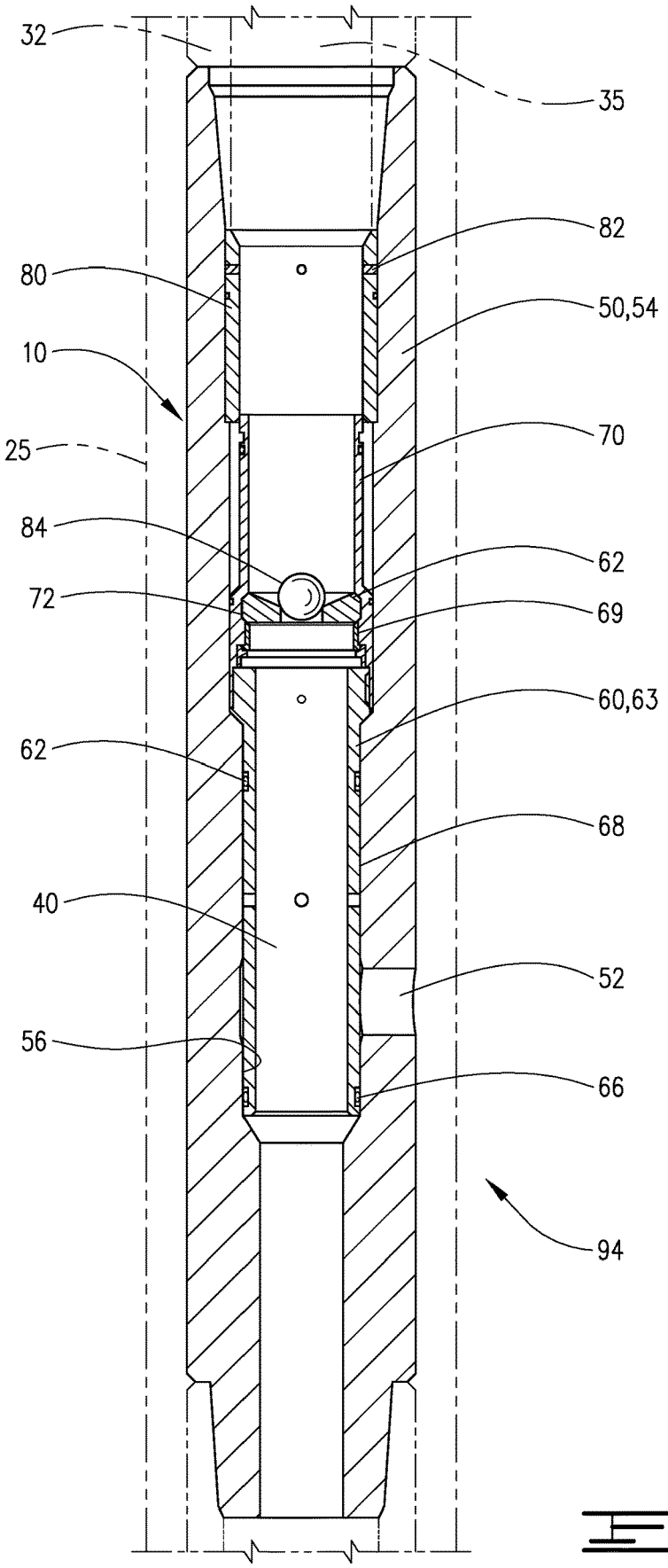
FIG. 4 illustrates a cross-sectional view of the surge reduction diverter tool disclosed herein after a ball has been seated and the diverter tool has been moved to a closed position.

Pressure is increased to a pressure sufficient to break shear pins 82, and closing sleeve will move to the closed position 94 shown in FIG. 4. In the closed position of FIG. 4, flow through tool 10 is still blocked. Pressure will be increased until closing ball 84 applies a sufficient force to shatter closing seat 62. The pressure at which the closing seat shatters is a second pressure that is higher than a first pressure that detaches the closing sleeve 60 from the tool body 50.

Figure 5:
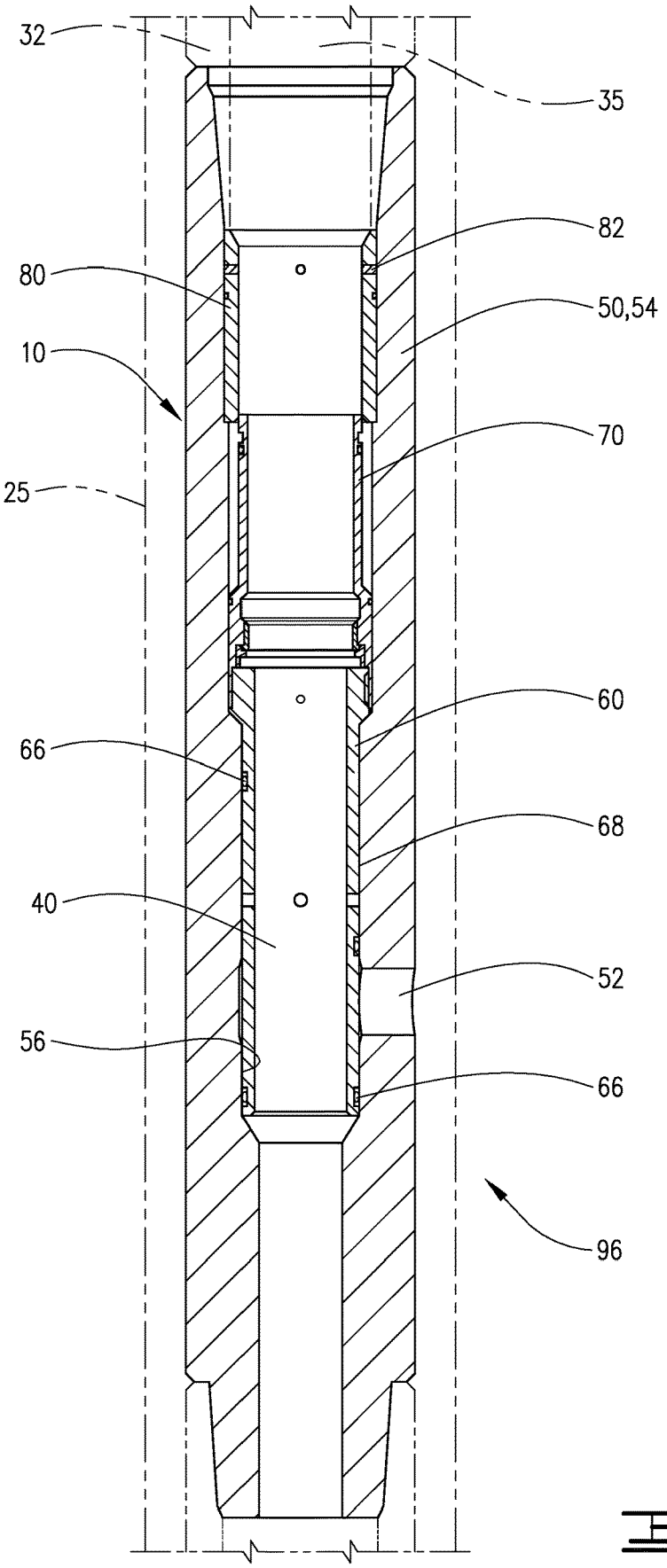
FIG. 5 illustrates a cross-sectional view of the surge reduction diverter tool disclosed herein after the frangible seat has been shattered.
Figure 5:
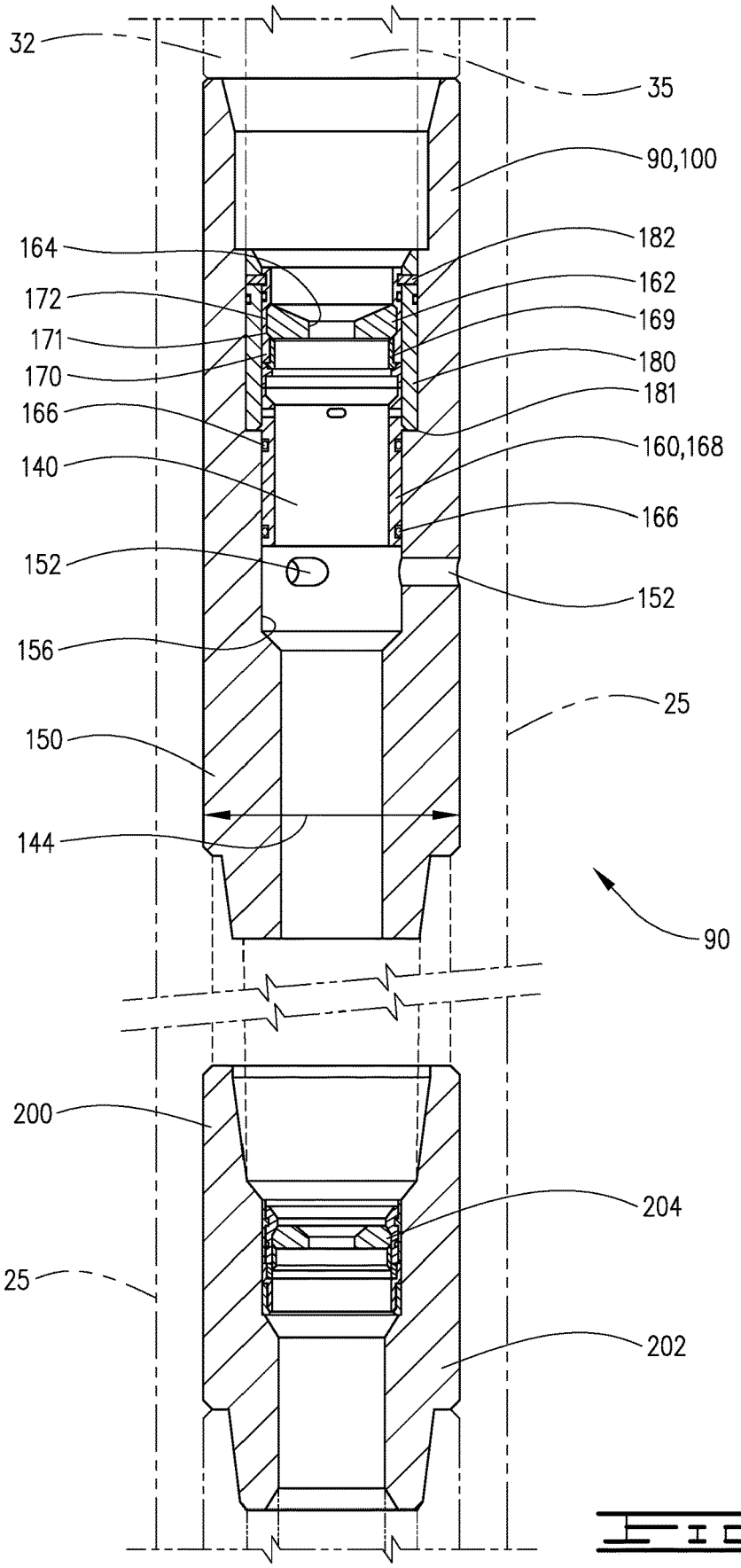

The glass seat in certain embodiments will shatter simultaneously, or almost simultaneous with reaching the closed position of the drill pipe diverter tool. The shattering may occur for example as a result of the impact created when closing sleeve body 68 reaches the closed position. Closing sleeve 60 may include an insert 69 with an upper end 71 that engages closing seat 62. Upper end 71 has an irregular, sharp, or otherwise configured surface that is in contact with glass seat 62. The engagement of the upper end 71 of insert 69 and glass seat 62 causes the shattering of the glass seat 62 when the impact resulting from the closing seat moving to the closed position is recognized. A pressure spike will be realized at that point, indicating that the ball 84 has landed and the closing seat 62 has shattered. The flow path 40 of surge reduction diverter tool 10 will be fully open, and cement can be flowed therethrough and through casing 30 therebelow and into the annulus 36 between the casing 30 and previously installed casing 27 (or open wellbore if no previously installed casing exists) to cement the casing 30 therein. The completed position 96 in which flow is allowed through diverter tool 10 is shown in FIG. 5.

The diverter tool 10 may be connected directly to casing 30 or may have tubulars, or other devices therebetween. In one embodiment a diverter confirmation device 200 may be utilized. FIGS. 6-9 show the use of the confirmation device 200. Each of FIGS. 6-9 includes an upper and lower section. The upper sections are of a surge reduction diverter tool 100 in the positions shown in FIGS. 2-5. Surge reduction diverter tool 100 is similar to surge reduction diverter tool 10, except that its construction results in a shorter assembly.

An outer diameter 144 of diverter tool 100 is smaller than an outer diameter 46 of the casing 30 therebelow. The outer diameter of the drill string 32 will in many cases be the same as the outer diameter 144, and in any case will be smaller than outer diameter 46. Surge reduction diverter tool 100 comprises a diverter body, or tool body 150, which may be a section of a drill pipe. Tool body 150 has a plurality of diverter ports 152 defined in wall 154 thereof. Tool body 150 has inner surface 156. Diverter ports 152 will communicate central flow path 140 of surge reduction diverter tool 100, and more particularly of tool body 150 with annulus 34.

A closing sleeve 160 is detachably connected in tool body 150 in a first position 161 shown in FIG. 6. A closing seat 162 is fixed to closing sleeve 160. Closing seat 162 may be identical to closing seat 62, and defines an opening 164 therethrough. Closing seat 162 is a frangible closing seat and in one embodiment is a glass closing seat that will shatter once engaged by a closing ball, and the application of pressure above the closing ball 84 is increased to provide sufficient force to shatter the closing seat 162. The closing seat 162 will shatter after the closing sleeve 160 has moved in the tool body 150 to close ports 152. Closing sleeve 160 has seals 166 that will sealingly engage an inner surface 156 of tool body 150.

Closing sleeve 160 comprises a closing sleeve body 168 and a closing sleeve extension 170 connected thereto. Insert 169 with upper end 171 may be positioned in closing sleeve 160 to engage frangible closing seat 162. Closing sleeve 160 has groove 172 defined therein in which closing seat 162 may be fixed. A mounting sleeve 180 is fixed in tool body 150. Mounting sleeve 180 is fixed against downward movement in tool body 150 by, for example, a shoulder 181 defined in tool body 50. Closing sleeve 160 is detachably connected in tool body 150. Shear pins 182 connect closing sleeve 160 to mounting sleeve 80 so that when detached, closing sleeve 160 is movable in tool body 150, while mounting sleeve 80 stays stationary. Either of diverter tool 10 or 100 may be used with, or without a confirmation device.

Figure 7:
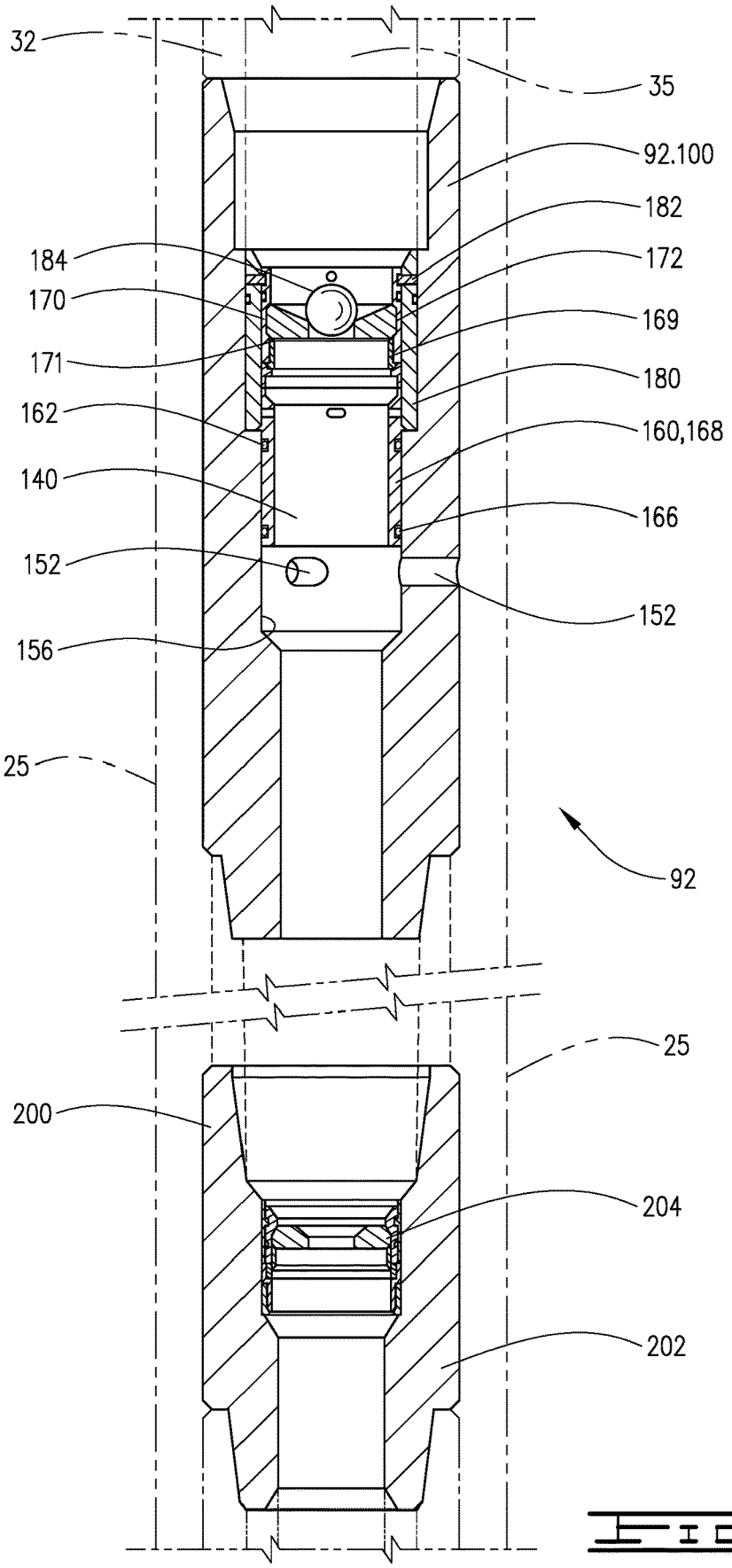
FIG. 7 illustrates a cross-sectional view of the surge reduction diverter tool disclosed herein after a ball has been seated used with a confirmation device.

In operation, surge reduction diverter tool 100 is connected to a work string, for example drill string 32. Drill string 32, with diverter tool 100 connected thereto will be connected to casing 30 therebelow. Surge reduction diverter tool 100 may be used in conjunction with an autofill device, for example float shoes or collars with autofill features that allow fluid to flow into the casing and upwardly therethrough as the casing 30 is lowered into a well bore. Diverter tool 100 is in the run-in position in FIG. 6. In the run-in position 90 fluid passing upwardly through the casing 30 will enter surge reduction diverter tool 100 and will pass out diverter ports 152 into annulus 34 outside surge reduction diverter tool 100. Once the casing 30 has reached the desired destination a shifting ball 84 may be dropped to engage closing seat 162. The landed position 92 of diverter tool 100 is shown in FIG. 7. In the landed position 92, the closing sleeve 160 has not yet moved to its second position 163 in tool body 150. When ball 84 is landed, the ball is seated such that there is no flow therethrough, and no pressure loss. As a result, the net pressure above ball 84 is used to move closing sleeve 160, and thereafter to shatter closing seat 162.

Figure 8:
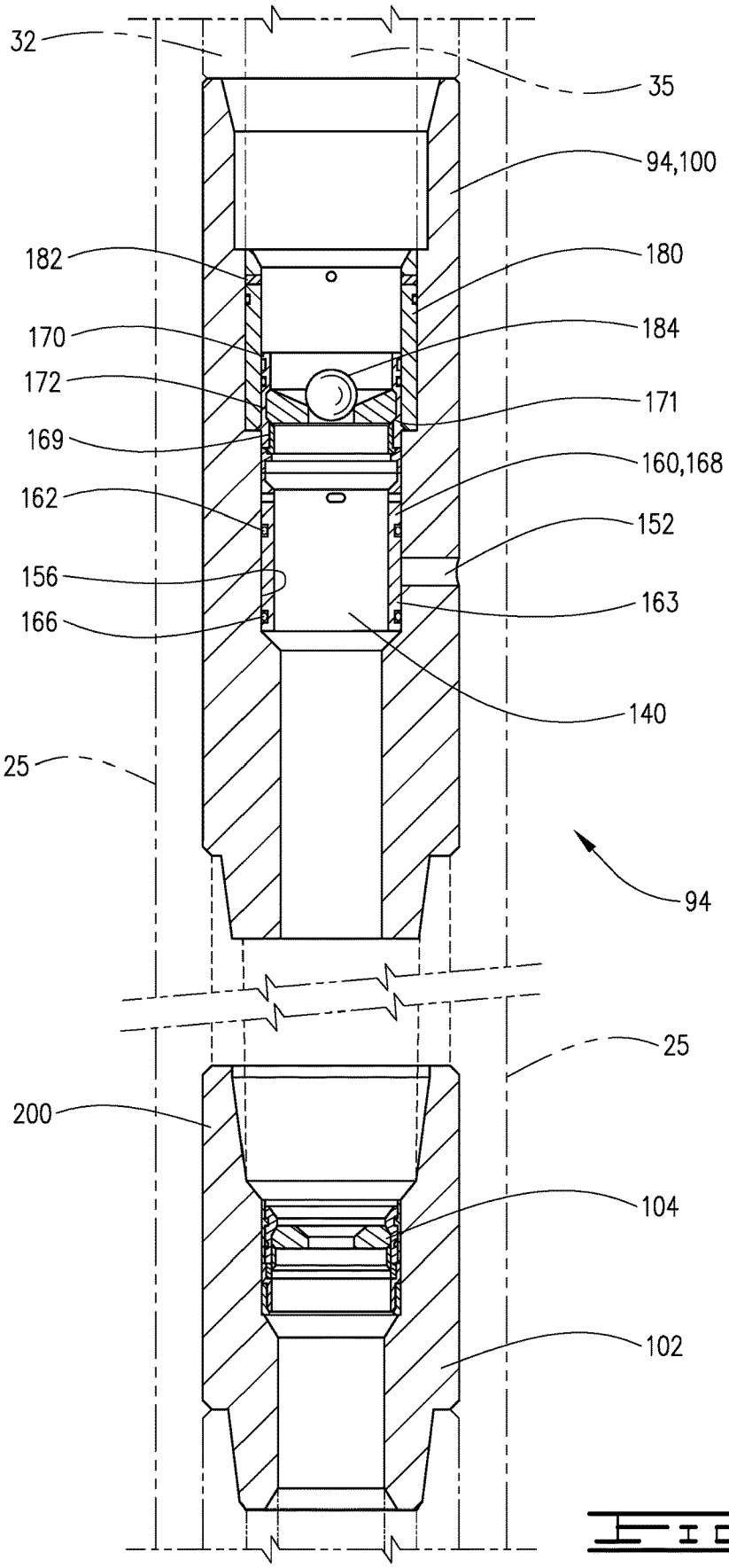
FIG. 8 illustrates a cross-sectional view of the surge reduction diverter tool disclosed herein after a ball has been seated and the diverter tool has been moved to a closed position used with a confirmation device.
Figure 8:
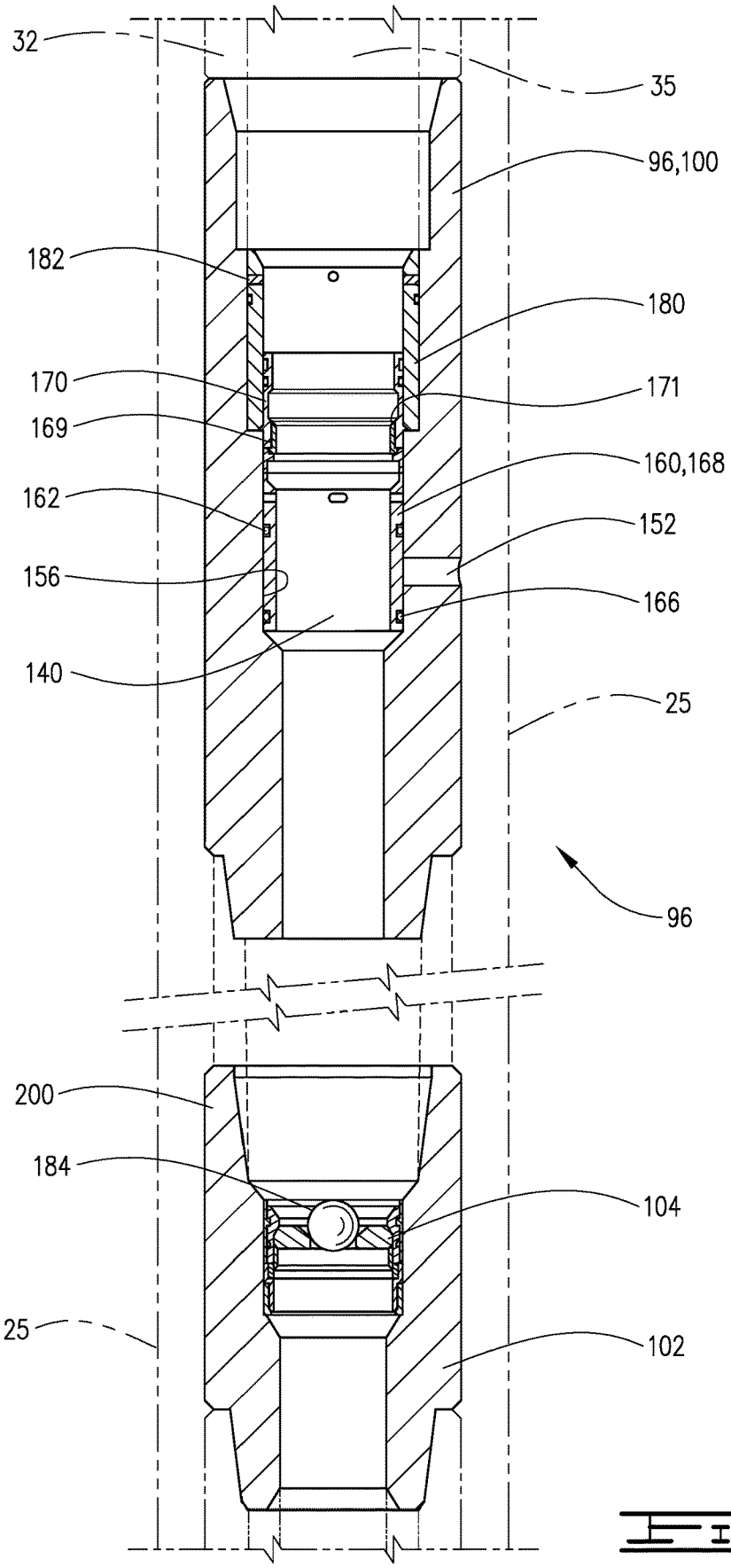

Pressure is increased to a pressure sufficient to break shear pins 182, and closing sleeve 160 will move to the closed position 94 shown in FIG. 8. In the closed position of FIG. 8, flow through tool 100 is still blocked. Pressure will be increased until closing ball 84 applies a sufficient force to shatter closing seat 62. The pressure at which the closing seat shatters is a second pressure that is higher than a first pressure that detaches the closing sleeve 160 from the tool body 150. The glass seat in certain embodiments will shatter simultaneously, or almost simultaneous with reaching the closed position of the drill pipe diverter tool. The shattering may occur for example as a result of the impact created when closing sleeve body 168 reaches the closed position. Closing sleeve 160 may include an insert 169 with an upper end 171 that engages closing seat 162. Upper end 171 has an irregular, sharp, or otherwise configured surface that is in contact with glass seat 162. The engagement of the upper end 171 of insert 169 and glass seat 162 causes the shattering of the glass seat 162 when the impact resulting from the closing seat moving to the closed position is recognized. A pressure spike will be realized at that point, indicating that the ball 84 has landed and the closing seat 162 has shattered. The flow path 40 of surge reduction diverter tool 100 will be fully open, and cement can be flowed therethrough and through casing 30 therebelow and into the annulus 36 between the casing 30 and previously installed casing 27 (or open wellbore if no previously installed casing exists) to cement the casing 30 therein. The completed position 96 in which flow is allowed through diverter tool 100 is shown in FIG. 9.

It is understood that confirmation device 200 may be connected to surge reduction diverter tool 10, or 100, directly, or by a string of tubulars, which may be for example a drill pipe. Confirmation device 200 comprises a tubular 202, which may be a section of drill pipe, and a frangible confirmation seat 204. Frangible confirmation seat 204 is mounted in tubular 202 and may be, for example, a glass confirmation seat which may be generally identical to closing seats 62 and 162. When confirmation device 200 is used with the embodiment of FIG. 2, shifting ball 84 will engage confirmation seat 204 after closing seat 62, has been shattered as shown in FIG. 8. Pressure is increased until confirmation seat 204 shatters, which creates a second pressure spike confirming closure, and all glass fragments will pass out of the casing therebelow, and cementing can occur through confirmation device 200 and the casing 30 to cement the casing 30 in the wellbore 25. The use of confirmation device 200 with diverter tool 100 is the same as described with respect to diverter tool 10. Therefore, the apparatus, methods, and systems of the present disclosure are well adapted to attain the ends and advantages mentioned as well as those that are inherent therein. Embodiments include:

Embodiment 1: A downhole tool comprising a tool body having a tool body outer diameter, a liner connected to the lower end of the tool body, the liner having a liner outer diameter that is larger than the tool body outer diameter; a plurality of diverter ports defined in a wall of the tool body; a closing sleeve detachably connected in the tool body in a first position; and a frangible seat disposed in the closing sleeve and positioned to receive a closing ball. The closing sleeve is detachable from the tool body and movable to a second position upon the application of a first pressure above the engaged closing ball, and the closing seat is breakable upon the application of a second pressure after the closing sleeve has moved to the second position in the tool body.

Embodiment 2: The downhole tool of embodiment 1, further comprising a confirmation seat positioned below the closing seat, the confirmation seat configured to receive the closing ball after the closing seat has shattered.

Embodiment 3. The downhole tool of embodiment 2, the confirmation seat comprising a frangible seat.

Embodiment 4. The downhole tool of embodiment 3, the closing seat and the confirmation seat comprising glass seats.

Embodiment 5. The downhole tool of any of embodiments 1-4, further comprising a mounting sleeve positioned in the tool body, the closing sleeve detachably connected to the mounting sleeve.

Embodiment 6. The downhole tool of embodiment 5, the closing sleeve comprising: a closing sleeve body; and a closing seat extension connected to the closing sleeve body, the closing seat extension detachably connected to the mounting sleeve.

Embodiment 7. A method of lowering a liner in a well comprising connecting a liner to a diverter tool; lowering the liner into the well with a drill string connected to the diverter tool; closing a plurality of ports in the diverter tool with a closing sleeve when the liner has reached a desired location in the well; and shattering a first frangible seat in the diverter tool after the plurality of ports are closed.

Embodiment 8. The method of embodiment 7, the diverter tool comprising: a diverter body; the closing sleeve detachably connected to the diverter body and the first frangible seat connected to the closing sleeve, the closing step comprising: engaging the frangible seat with a closing ball, increasing the pressure in the drill pipe above the diverter tool to a pressure sufficient to detach the closing sleeve; and moving the closing sleeve to a second position to block flow through the diverter ports.

Embodiment 9. The method of embodiment 8, wherein the frangible seat rests upon an upper end of a portion of the closing seat, the shattering step comprising generating an impact when the closing seat reaches the second position to shatter the frangible seat after the closing sleeve has moved to the second position, the method further comprising confirming the closing of the diverter ports.

Embodiment 10. The method of embodiment 9, the confirming step comprising engaging a second frangible seat positioned below the first frangible seat with the closing ball; and shattering the second frangible seat.

Embodiment 11. The method of any of embodiments 7-10, the first frangible seat comprising a glass seat.

Embodiment 12. The method of any of embodiments 7-11, the diverter tool having a first outer diameter and the liner having a second outer diameter, the second outer diameter being larger than the first outer diameter.

Embodiment 13. The method of any of embodiments 8-12, further comprising engaging a second frangible seat with the closing ball below the first frangible seat; and shattering the second frangible seat.

Embodiment 14. A downhole tool for use in a well comprising: a liner having a first outer diameter; a diverter tool having a second outer diameter connected to the liner, the diverter tool comprising: a diverter body, the diverter body defining a central flow passage and a plurality of diverter ports, the diverter ports communicating the central flow passage with an annulus between the well and the diverter body; a first closing seat disposed in the diverter body; and a closing sleeve detachably connected in the diverter body and movable from a first position in the diverter body to a second position in which the closing sleeve prevents flow through the diverter ports, the closing sleeve movable from the first to the second position as a result of pressure in the diverter tool above a closing ball engaged with the first closing seat, the first closing seat comprising a frangible closing seat that shatters after the closing sleeve moves to the second position.

Embodiment 15. The downhole tool of embodiment 14, the first closing seat comprising a glass seat.

Embodiment 16. The downhole tool of either of embodiments 14 or 15 further comprising a second frangible seat disposed below the first frangible seat.

Embodiment 17. The downhole tool of embodiment 16, the second frangible seat comprising a glass seat.

Embodiment 18. The downhole tool of either of embodiments 16 or 17, the second frangible seat comprising a confirmation seat, wherein a pressure spike recognized after the closing ball engages the second frangible seat confirms the closure of the diverter ports.

Embodiment 19. The downhole tool of any of embodiments 14-18, further comprising a mounting sleeve positioned in the diverter body, the closing sleeve detachably connected to mounting sleeve.

Embodiment 20. The downhole tool of embodiment 19, the closing sleeve comprising a closing sleeve body and a closing sleeve extension, the closing sleeve extension connected to the mounting sleeve.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more cement compositions, flow ports, etc., as the case may be, and does not indicate any sequence. Furthermore, it is to be understood that the mere use of the word "first" does not require that there be any "second," and the mere use of the word "second" does not require that there be any "third," etc.

What is claimed is:

1. A downhole tool comprising:

a tool body having a tool body outer diameter;

a liner connected to the lower end of the tool body, the liner having a liner outer diameter that is larger than the tool body outer diameter;

a plurality of diverter ports defined in a wall of the tool body;

a closing sleeve detachably connected in the tool body in a first position; and a frangible seat disposed in the closing sleeve and positioned to receive a closing ball, the closing sleeve detachable from the tool body and movable to a second position upon the application of a first pressure above the engaged closing ball, the frangible seat being breakable into a plurality of pieces that pass through the liner upon the application of a second pressure after the closing sleeve has moved to the second position in the tool body.

2. The downhole tool of claim 1, further comprising a confirmation seat positioned below the frangible seat, the confirmation seat configured to receive the closing ball after the closing seat has shattered.

3. The downhole tool of claim 2, the confirmation seat comprising a frangible seat that shatters into a plurality of pieces that pass through the liner.

4. The downhole tool of claim 3, the closing seat and the confirmation seat comprising glass seats.

5. The downhole tool of claim 1, further comprising a mounting sleeve positioned in the tool body, the closing sleeve detachably connected to the mounting sleeve.

6. The downhole tool of claim 5, the closing sleeve comprising:

a closing sleeve body; and a closing seat extension connected to the closing sleeve body, the closing seat extension detachably connected to the mounting sleeve.

7. A method of lowering a liner in a well comprising:

connecting a liner to a diverter tool;

lowering the liner into the well with a drill string connected to the diverter tool;

closing a plurality of ports in the diverter tool with a closing sleeve when the liner has reached a desired location in the well; and shattering a first frangible seat in the diverter tool into a plurality of pieces that pass through the liner after the plurality of ports are closed.

8. The method of claim 7, the diverter tool comprising:

a diverter body; and the closing sleeve detachably connected to the diverter body and the frangible seat connected to the closing sleeve, the closing step comprising:

engaging the first frangible seat with a closing ball;

increasing the pressure in the drill pipe above the diverter tool to a pressure sufficient to detach the closing sleeve; and moving the closing sleeve to a second position to block flow through the diverter ports.

9. The method of claim 8, wherein the frangible seat rests upon an upper end of a portion of the closing sleeve, the shattering step comprising generating an impact when the closing sleeve reaches the second position to shatter the first frangible seat after the closing sleeve has moved to the second position, the method further comprising confirming the closing of the diverter ports.

10. The method of claim 9, the confirming step comprising:

engaging a second frangible seat positioned below the first frangible seat with the closing ball; and shattering the second frangible seat into a plurality of pieces that pass through the liner.

11. The method of claim 7, the first frangible seat comprising a glass seat.

12. The method of claim 7, the diverter tool having a first outer diameter and the liner having a second outer diameter, the second outer diameter being larger than the first outer diameter.

13. The method of claim 8, further comprising:

engaging a second frangible seat with the closing ball below the first frangible seat; and shattering the second frangible seat into a plurality of pieces that pass through the liner.

14. A downhole tool for use in a well comprising:

a liner having a first outer diameter;

a diverter tool having a second outer diameter connected to the liner, the diverter tool comprising:

a diverter body, the diverter body defining a central flow passage and a plurality of diverter ports, the diverter ports communicating the central flow passage with an annulus between the well and the diverter body;

a first closing seat disposed in the diverter body; and a closing sleeve detachably connected in the diverter body and movable from a first position in the diverter body to a second position in which the closing sleeve prevents flow through the diverter ports, the closing sleeve movable from the first to the second position as a result of pressure in the diverter tool above a closing ball engaged with the first closing seat, the first closing seat comprising a frangible closing seat that shatters into a plurality of pieces that pass through the liner after the closing sleeve moves to the second position.

15. The downhole tool of claim 14, the first closing seat comprising a glass seat.

16. The downhole tool of claim 14 further comprising a second frangible seat disposed below the first frangible seat.

17. The downhole tool of claim 16, the second frangible seat comprising a glass seat that shatters into a plurality of pieces that pass through the liner.

18. The downhole tool of claim 16, the second frangible seat comprising a confirmation seat, wherein a pressure spike recognized after the closing ball engages the second frangible seat confirms the closure of the diverter ports.

19. The downhole tool of claim 14, further comprising a mounting sleeve positioned in the diverter body, the closing sleeve detachably connected to the mounting sleeve.

20. The downhole tool of claim 19, the closing sleeve comprising a closing sleeve body and a closing sleeve extension, the closing sleeve extension connected to the mounting sleeve.

* * * * *